United States Patent [19]

Luz

[11] Patent Number: 4,528,808

[45] Date of Patent: Jul. 16, 1985

[54] METHOD AND APPARATUS FOR PREPARING YARN ENDS FOR SLICING

[75] Inventor: Rudolf Luz, Horgen, Switzerland

[73] Assignee: Maschinenfabrik Schweiter Ag, Horgen, Switzerland

[21] Appl. No.: 504,065

[22] Filed: Jun. 14, 1983

[30] Foreign Application Priority Data

Jul. 1, 1982 [CH] Switzerland ..... 4019/82

[51] Int. Cl.[3] ..... D01H 15/00

[52] U.S. Cl. ..... 57/22

[58] Field of Search ..... 57/22, 23, 261, 263, 57/304

[56] References Cited

U.S. PATENT DOCUMENTS 4,263,775 4/1981 Mima ..... 57/22
4,411,128 10/1983 Mima ..... 57/22
4,419,859 12/1983 Mima ..... 57/22

*Primary Examiner*—Donald Watkins
*Attorney, Agent, or Firm*—Roylance, Abrams, Berdo & Goodman

[57] ABSTRACT

Prior to the actual splicing process, a preparation process is carried out in a preparation apparatus. The apparatus comprises a preparation tube having one or more circumferentially arranged air jet nozzles. The axis of each nozzle is inclined to the axis of the preparation tube and has a mouthpiece at the inlet end. The yarn end to be prepared is introduced into the preparation tube, where it is separated by the air jet emanating from the mouth piece and is spread apart.

8 Claims, 7 Drawing Figures

METHOD AND APPARATUS FOR PREPARING YARN ENDS FOR SLICING

This invention relates to a method and apparatus for preparing yarn ends for splicing by opening the filaments thereof while the cut yarn ends are held prior to insertion into a splicing chamber.

BACKGROUND OF THE INVENTION

It is well known to employ a splicing process for the purpose of joining together two yarn ends which are formed during the processing of yarns, for example, during spooling or winding. The actual splicing process is preceded by a preparation process in which the filaments of the yarn ends are disengaged and separated from one another. In two known methods for splicing yarn ends, shown in German OS No. 2,945,504 and OS No. 2,939,481, the preparation process for the yarn ends is carried out by air jet nozzles. In these nozzles, a twisting motion is imparted to the yarn ends by various means such as, for example, transverse holes.

It must be ensured that the direction imparted is opposite to the yarn twisting direction so that the yarn end is separated by untwisting, but this also involves a risk of overtwisting, either in the reverse direction or, if the air direction is incorrect, overtwisting without accomplishing any untwisting. If yarns having a S-twist are replaced by yarns having a Z-twist while using one of these methods, it is necessary during this changeover to also reverse the direction of the angular momentum of the air imparted by the air jets. Apart from this disadvantage, there is the further problem that these methods are not suitable for yarns not having a well-defined twist such as, for example, twines or open-ended yarns.

SUMMARY OF THE INVENTION

Accordingly, an object of the present invention is to provide a method for effective separation and spreading-apart of the filaments of the yarn ends without adversely influencing the splicing process as a result of this preparation.

A further object is to provide a method and apparatus which effectively spreads apart the filaments of yarn ends in preparation for splicing, the method and apparatus being much more universally usable for various kinds of yarns, without modification, than previously possible.

Briefly described, the invention includes a method of preparing two yarn ends for subsequent splicing in a splicing chamber while the yarn ends are cut and held and before insertion into the splicing chamber, comprising subjecting the yarn ends to a jet of air directed against each of the yarn ends for separating and blowing out the filaments of the yarns, the jet being directed toward the yarn end at an angle and without rotational momentum.

In another aspect, the invention includes an apparatus for preparing cut and held yarn ends for splicing in a splicing chamber comprising a preparation tube; means for inserting a yarn end into and along the axis of said preparation tube; means defining an air jet passage extending into said preparation tube for directing a jet of air at said yarn end, said passage forming an acute angle with the axis along which said yarn is inserted.

As will be recognized from the above, the yarn ends are exposed to the action of at least one air jet free of angular momentum, the jet being directed against the yarn end outside of the splicing chamber, as a result of which the filaments are separated and the yarn ends are expanded or blown out.

The preparation tube in the apparatus of the invention for receiving, separating and spreading apart the yarn end is positioned outside of the splicing chamber.

BRIEF DESCRIPTION OF THE DRAWINGS

In order that the manner in which the foregoing and other objects are attained in accordance with the invention can be understood in detail, particularly, advantageous embodiments thereof will be described with reference to the accompanying drawings, which form a part of this specification, and wherein.

DETAILED DESCRIPTION OF THE PREFERRED EMBODIMENTS

Figure 1:
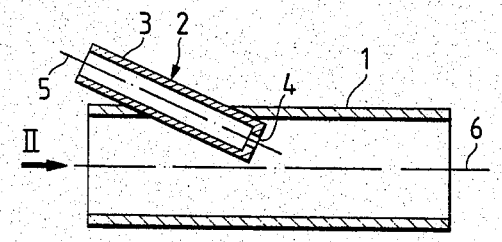
FIG. 1 is a side elevation, in longitudinal section, of a preparation tube in accordance with the invention.

The invention is based on the concept that it is appropriate to locally separate the preparation process for the yarn ends. This makes it possible to carry out the preparation in an optimum manner, i.e., the separation and spreading apart of the yarn end filaments, so that the subsequent splicing results in a junction of the yarn ends whose strength corresponds to that of the yarn itself and in which it is scarcely possible to discern a difference between the junction and the remainder of the yarn. Although the splicing chambers are locally separated from the preparation device, the preparation process can pass substantially uninterrupted into the splicing process. As a device for performing the preparation process is required for each yarn end, and in view of the fact that yarn ends are normally inserted from opposite sides into a splicing chamber, it is appropriate to position one of the preparation devices on one side of the splicing chamber and a second preparation device on the other side, oppositely oriented so that the yarn ends, which are firmly held by gripping devices, can be inserted simultaneously into the tube preparation devices, prepared, and then removed from the preparation devices and immediately inserted into the splicer.

FIGS. 1–7 show various embodiments with which the preparation process in accordance with the invention can be carried out. In the embodiment shown in FIGS. 1 and 2, the apparatus comprises a cylindrical preparation tube 1 into which is inserted one of the two yarn ends to be joined, the yarn end being inserted in the direction of arrow II. Means defining an air jet passage indicated generally at 2 comprises an air jet pipe 3 which extends through the wall of tube 1 into the interior thereof, the inner end of pipe 3 having a mouthpiece 4 of reduced diameter. The other end of tube 3 is, of course, coupled to a controllable air supply, now shown. As can be understood from FIG. 1, the axis 5 of pipe 3 and mouthpiece 4 is inclined with respect to the axis 6 of preparation tube 1 along which the yarn is inserted. The slope of axis 5 can be adapted to the particular conditions, but the angle between the insertion axis and axis 5 is an acute angle. The portion of nozzle or passage 2 projecting into the inner portion of the preparation tube can have a length suitable for the effective preparation of the yarn end. Nozzle 2 leads to the formation of a clearly defined air jet through mouthpiece 4 which is directed against the yarn end and brings about the separation and spreading apart of the filaments.

Figure 2:
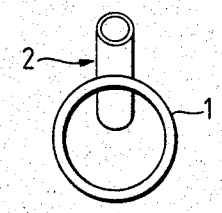
FIG. 2 is an end elevation of the preparation tube of FIG. 1 from the direction of arrow II.
Figure 3:
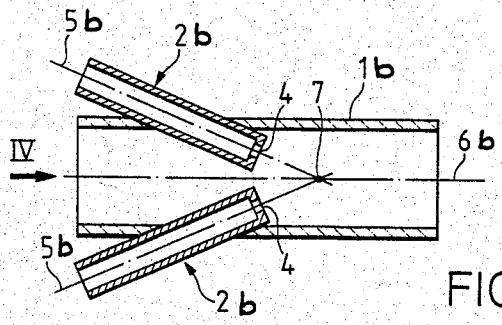
FIG. 3 is a side elevation, in longitudinal section, of a further embodiment of a preparation tube in accordance with the invention.
Figure 4:
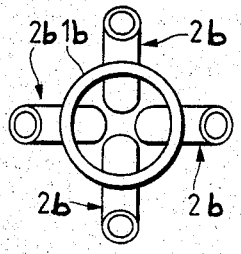
FIG. 4 is an end elevation of the preparation tube of FIG. 3, viewed in the direction of arrow IV.

FIGS. 3 and 4 show an embodiment which is somewhat similar to that of FIGS. 1 and 2 but which, in place of a single air jet nozzle 2, has four such nozzles **2*b* which are uniformly distributed around the circumference of preparation tube 1*b*. The axes 5*b* of all of the nozzles intersect at a common point 7 on axis 6*b* of the preparation tube. For the preparation of the yarn end, the yarn is introduced in the direction of arrow IV into tube 1*b* to a location at which those portions of the nozzles projecting into the preparation tube form a reduction of the cross-section as will be seen in FIG. 4, the size of the remaining opening being a function of the lengths of the portions of the nozzles 2*b* projecting into tube 1*b***.

Figure 5:
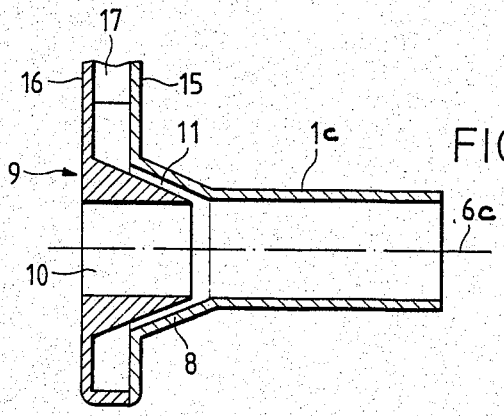
FIG. 5 is a side elevation, in longitudinal section, of a third embodiment of a preparation tube in accordance with the invention.

A further embodiment is shown in FIG. 5 in which the end of the preparation tube **1*c* from which the yarns are inserted is provided with a conically enlarged portion 8 into which projects a countercone 9 having a central bore 10, cone 9 forming an annular conical clearance 11 with the conical portion 8**, defining a generally conical passageway.

In this embodiment, the annular clearance 11 forms the air jet nozzle through which a cone of air passes, the apex of the cone being located on axis **6*c* of the preparation tube. The wall portions 15, 16 merge into the enlarged portion 8 and the countercone 9, forming a feed conduit 17 through which the entering compressed air exerts a uniform action on the annular clearance 11. The preparation process using the apparatus shown in FIG. 5 takes place in essentially the same way as with the devices of FIGS. 1 and 2 or 3 and 4. The yarn end is inserted or sucked through bore 10 and the separation and spreading apart of the filaments of the yarn takes place in the preparation tube 1*c*. In FIG. 5, bore 10 is approximately the same as the internal diameter of preparation tube 1*c*, but it is also possible to choose a different diameter for bore 10**.

Figure 6:
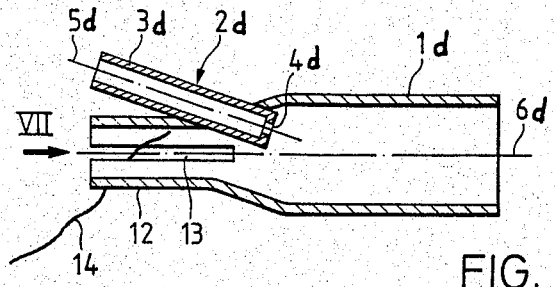
FIG. 6 is a side elevation, in longitudinal section, of a fourth embodiment of a preparation tube in accordance with the invention.
Figure 7:
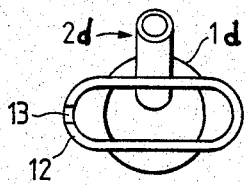
FIG. 7 is an end elevation of the preparation tube of FIG. 6, viewed in the direction of arrow VII.

FIGS. 6 and 7 show still another embodiment of a preparation apparatus in accordance with the invention. At the inlet side into which the yarn is inserted, the cylindrical preparation tube **1*d* merges smoothly into a flattened, generally oval inlet portion 12. At the transition between inlet portion 12 and preparation tube 1*d* is positioned the air jet nozzle 2*d* whose air jet pipe 3*d* projects somewhat into the preparation tube. The air jet nozzle 2*d* is constructed in the same way as that of FIGS. 3 or 1 and its axis slopes relative to axis 6*d* of preparation tube 1*d*. A slot 13 is formed in inlet portion 12 and lies in a plane which contains axis 6*d*, the slot extending up to the transition between the inlet portion 12 and preparation tube 1*d*. The slot 13 is used for improving the gripping of a yarn end 14 when it is in the vicinity of the inlet portion 12 and is drawn into preparation tube 1*d* in which it is prepared by the induced flow produced through jet nozzle 2*d*. In place of the single air jet nozzle 2*d* shown in FIG. 6**, it is possible to provide two, three or more nozzles.

In the preparation devices described, it is important that the filaments of the sucked-in yarn ends are not only separated but are also spread apart by a directed air jet. This spreading-apart of the yarn end is the prerequisite for a completely satisfactory spliced joint without projecting filament ends which, as is known, can lead to machine stoppages or even to thread breaks during further subsequent processing. The use of the described preparation devices makes it possible to very simply prepare all types of yarns substantially without conversions or changes, including ring yarns, open-ended yarns, twines, and the like, for the purpose of preparing these for satisfactory splicing. It is also important that the preparation take place in the absence of air streams having angular momentum or rotary motion with respect to the axis of the preparation tube.

The preparation device of FIGS. 6 and 7 is intended for particularly short filament suction times. The yarn to be prepared is placed by the insertion apparatus of the splicing means at right angles over the preparation tube **1*d* or at right angles across the filament insertion slot 13. The depth of slot 13 and the mouthpiece 4*d* of nozzle 2*d* must be as close as possible to one another. In addition, to ensure the proper functioning of the preparation device, the preparation tube 1*d* must have a certain length from its inlet to the mouthpiece or mouthpieces 4*d* in which the yarn end to be prepared can move freely. The individual parameters of the preparation apparatus can be varied, as required. It may optionally be appropriate to start the preparation process at the same time as the splicing process. The pressure of the air jets from mouthpieces 4 can be higher or lower than the pressure used for splicing in the splicing chamber. There is no need to direct all of the axes 5 of the air jet nozzles 2 onto the same impact point 7. The arrangement of the nozzles can also be varied in the sense that two or more can be arranged in a series in the direction of axis 6 of preparation tube 1. The mouthpieces 4** can also have a surface differing from a circular surface. Finally, the compressed air can act on the yarn end in the form of air blasts instead of as a continuous stream.

While certain advantageous embodiments have been chosen to illustrate the invention, it will be understood by those skilled in the art that various changes and modifications can be made therein without departing from the scope of the invention as defined in the appended claims.

What I claim is:

1. A method of preparing yarn ends for subsequent splicing in a splicing chamber, while the yarn ends are held and before insertion into the splicing chamber, comprising:

holding a yarn end;

emitting a jet of air directly against the yarn end within a partially closed chamber for separating and blowing out filaments of the yarn, the jet being directed toward the yarn end at an angle and without rotational momentum at impact with the yarn end; and modifying at least one of jet pressure, jet intensity and jet duration during separation.

2. An apparatus for preparing cut and held yarn ends for splicing in a splicing chamber, comprising: a preparation tube having a longitudinal axis and holding means for positioning a yarn end at a position in said tube;

means for inserting a yarn end into and along the axis of said preparation tube; and a plurality air jet passages extending into said preparation tube for directing jets of air directly at the yarn end, said passages forming an acute angle with the axis along which the yarn is inserted, and at least one of said air jet passages being aimed directly at said position for the yarn end such that one air jet impacts the yarn end without rotational momentum.

3. A method according to claim 1 wherein the yarn end is held in a preparation tube; and the air jet contacts the yarn before contacting the preparation tube.

4. A method of preparing yarn ends for subsequent splicing in a splicing chamber, while the yarn ends are held and before insertion into the splicing chamber, comprising:

holding a yarn end;

directing a jet of air against the yarn end for separating and blowing out filaments of the yarn, the jet being directed toward the yarn end at an angle and without rotational momentum; and modifying at least one of jet pressure, jet intensity and jet duration characteristics during separation.

5. An apparatus for preparing cut and held yarn ends for splicing in a splicing chamber, comprising:

a preparation tube having a longitudinal axis;

means for inserting a yarn end into and along the axis of said preparation tube; and means defining a plurality of air jet passages extending into said preparation tube for directing jets of air at said yarn end, said passages forming acute angles with the axis along which the yarn is inserted.

6. An apparatus according to claim 5 wherein the longitudinal axes of said passages intersect the axis of said tube.

7. An apparatus for preparing cut and held yarn ends for splicing in a splicing chamber, comprising:

a preparation tube having a longitudinal axis;

means for inserting a yarn end into and along the axis of said preparation tube; and means defining an air jet passage extending into said preparation tube for directing a jet of air at said yarn end, said passage forming an acute angle with the axis along which said yarn is inserted and having a conical annular nozzle opening along at least part of an inner circumference of said tube.

8. An apparatus for preparing cut and held yarn ends for splicing in a splicing chamber, comprising:

a preparation tube having a longitudinal axis and an inlet end which is generally oval in shape;

means for inserting a yarn end into and along the axis of said preparation tube; and means defining an air jet passage extending into said preparation tube for directing a jet of air at said yarn end, said passage forming an acute angle with the axis along which said yarn is inserted.

* * * * *